US006361193B1

(12) United States Patent
Gabrius et al.

(10) Patent No.: US 6,361,193 B1
(45) Date of Patent: Mar. 26, 2002

(54) PULL-ON BIFURCATED CLIP FOR IMPROVED REFLECTOR TRIM RETENTION

(75) Inventors: Algimantas John Gabrius, Oxford, GA (US); James Patrick Yates, Charleston, IL (US)

(73) Assignee: NSI Enterprises, Inc., Atlanta, GA (US)

( * ) Notice: Subject to any disclaimer, the term of this patent is extended or adjusted under 35 U.S.C. 154(b) by 0 days.

(21) Appl. No.: 09/653,532

(22) Filed: Aug. 31, 2000

(51) Int. Cl.[7] ..... F21V 17/00

(52) U.S. Cl. ..... 362/365; 362/147; 362/396; 362/404

(58) Field of Search ..... 362/365, 147, 362/364, 396, 404

(56) References Cited

U.S. PATENT DOCUMENTS 5,707,143 A * 1/1998 Hentz ..... 362/365

* cited by examiner

*Primary Examiner*—Stephen Husar
*Assistant Examiner*—Ali Alavi
(74) *Attorney, Agent, or Firm*—Kenneth E. Darnell

(57) ABSTRACT

An improved pull-on clip intended to position and maintain in place a reflector trim within a downlighting housing or "can" and particularly to bias the trim against an opening in a ceiling to retain a finishing flange of the trim in place about the opening. The present clip can be manually assembled to the trim by means of a snap-fastening structure provided on an attachment end of the clip, the use of tools being unnecessary for assembly of the clip to the trim. The clip facilitates lamp positioning within the can and thereby within the fixture such that optimum lamp performance is obtained. A bifurcated distal body portion of the clip provides separately flexible finger portions each having at least two points thereon, the points engaging interior walls of the trim to provide positive connection thereto such that the flexing action of the fingers exert a seating force against the trim which snugly positions the trim about the ceiling opening, thereby providing a clean appearance and positive lamp placement. The invention particularly improves on the clip of U.S. Pat. No. 5,707,143.

24 Claims, 2 Drawing Sheets

PULL-ON BIFURCATED CLIP FOR IMPROVED REFLECTOR TRIM RETENTION

BACKGROUND OF THE INVENTION

1. Field of the Invention

The invention relates generally to mounting structure for positioning and holding a reflector trim within a lamp housing of a downlighting fixture or similar lighting fixture, the invention particularly relating to an inexpensive pull-on clip of improved structure which can be rapidly assembled onto a reflector trim for mounting of the trim within a lamp housing.

2. Description of the Prior Art

Downlighting provides a flexibility not available with most other categories of lighting due to the ability to employ a variety of fixtures intended for downlight purposes to lighting situations which range from ambient to accent to wall-washing and the like. Where desired, downlighting can also be used in task lighting applications. The flexibility of downlighting is not limited to use situations but also extends to appearance and even to the use of a variety of differing lamp choices in most downlighting fixtures. With cost always a consideration in any lighting choice, it becomes necessary to provide downlighting fixtures which can be inexpensively manufactured and installed with the least intensive labor use while providing the most optimal lighting performance. Lighting fixtures so configured must also be easily and rapidly installable not only by relatively skilled labor such as in new construction but also by relatively unskilled labor such as by a home owner in a retrofit situation. Downlighting fixtures comprising varying "rough-in" structures are common in the marketplace and vary in complexity and cost. Such fixtures are manufactured and marketed by Lithonia Lighting of Conyers, Ga., Lithonia Lighting being a part of the Lithonia Lighting Group which is a division of National Service Industries, Inc. of Atlanta, Ga. In these fixtures as in downlighting fixtures produced by others, an intent has been the manufacture of effective fixtures having the best possible performance at the least possible fixture cost and the least possible involvement of installation labor. Fixtures having these desirable characteristics must include structure insertable into a lamp housing or "can" and which will positively secure lamping, a reflector trim with or without a baffle and a lamp socket within the can with positive lamp positioning and with positioning of the reflector trim snugly against a ceiling hole such that a gap does not exist between the trim and peripheral edge portions of the ceiling which surround the ceiling hole. While relatively complex and expensive mechanisms can be and are employed in at least some downlighting fixtures to produce the necessary results, the achievement of such results inexpensively and with mechanical simplicity is less than commonplace in the industry. Desirable mechanical simplicity in the industry now extends even to the very insertion of a reflector trim and lamp socket assembly into the can, standard practices in the industry essentially requiring the ability to insert such an assembly into the can in a single motion with concurrent fitting of annular flange-like portions of the tri about the ceiling hole above which the fixture is operatively mounted. In the prior art, clip-like structures riveted to the reflector trim have been used to hold the trim and socket assemblies within a can. These prior clip structures have generally required assembly to trim reflectors in a manufacturing environment and could not be reasonably attached on the job site. Clip attachment to reflector trim in the manufacturing environment further allows shipment of trim to a job site to be inefficient due to the bulky nature of reflector trim having preattached assembly clips, each trim being incapable of packaging in a nesting relation to each other such as will be possible if clips could be installed easily and rapidly on the job site. A clip capable of functioning in the manner described is disclosed and claimed in U.S. Pat. No. 5,707,143 and provides an improved mechanism for mounting a reflector trim or a reflector trim and lamp socket assembly within a lamp housing or can to achieve the results and economies alluded to herein. It is to be noted that Blaisdell et al, in U.S. Pat. No. 4,388,679; Basile, in U.S. Pat. No. 4,593,344; and Zadeh, in U.S. Pat. No. 5,440,471 also provide mechanisms which are of interest relative to achievement of the desired goals enumerated herein.

The present invention intends solution to certain deficiencies of the prior art by providing a reflector trim assembly which can also include a lamp socket mountable to the trim and which can be easily and rapidly mounted with positive securement within the interior of a lamp housing or can of a downlighting fite or similar lighting fixture. The invention includes assembly clip structure of improved characteristics capable of attachment to a reflector trim on a job site without the use of tools, thereby allowing reflector trim to be compactly packaged in a nesting arrangement for shipment to the job site. The present clip can rapidly be attached to the reflector trim without damage to the trim The invention further provides for improved positive retention of the reflector trim and any associated structure within the can with positive lamp positioning for optimal lighting performance and with snug fitting of the trim against a ceiling surface about a ceiling opening through which light is directed from the downlighting fixture. The improved structure of the invention provides finger-like projections having multiple points at distal ends of the projections, the structure acting to "snug" the reflector trim against the ceiling about the opening to prevent the existence of an unsightly gap between the trim and the ceiling, thus preventing light leakage and providing a clean appearance. The advantages of the invention are realized with net cost reductions in manufacturing, product shipment and job site installation.

SUMMARY OF THE INVENTION

The invention particularly provides improvement upon the clip disclosed and claimed in U.S. Pat. No. 5,707,143, the disclosure of which is incorporated hereinto by reference. The present clip structure has in common with the clip of the patent the ability to mount a reflector trim and any associated structure within a downlighting fixture "rough-in". The present clip can be easily and quickly pulled onto a penultimate body portion of a reflector trim and locked thereto by means of a fitting of a locking tab of the clip into an aperture formed in the reflector trim the clip thus being positively secured to the reflector trim manually and without the use of tools. Two of the "pull-on" clips are mounted one each to each side of the trim although it is to be understood that more than two of the clips could be used as desired. Regardless of the number of clips used, the clips are regularly spaced about upper portions of the reflector trim and are attachable thereto without the use of tools. The structure of the present clip allows attachment thereof to the reflector trim at a job site, thereby allowing reflector trim to be compactly packaged and shipped to the job site with optimum economy. Use of the present pull-on clips provides positive lamp positioning on single motion insertion of the reflector trim assembly into a lamp housing or can with improved fitting of a trim flange of the reflector trim assembly against ceiling surfaces about an opening above which a downlighting fixture is mounted to provide a clean appearance and to prevent light leakage.

The attachment end of the improved pull-on clip of the present invention particularly includes a locking tab similar to the locking tab disclosed in U.S. Pat. No. 5,707,143, with the exception that the locking tab of the present structure is taken to be approximately twice as long as the locking tab of the patent. The locking tab of the present invention is also provided with an angled lead-in element formed distally of the locking tab to facilitate assembly of the clip to the reflector trim without damage to portions of the trim over which the locking tab must pass in order to reach a slot formed in the reflector trim into which the locking tab snap-fits in order to positively mount the clip to the trim A "tighter" bend in formation of clipping elements of the clip eliminates undesirable "rocking" of the clip once assembled and reduces effective retention forces.

The free end of the pull-on clip is bifurcated to form two finger-like elements each having sharpened points at distal ends thereof the points "biting" into inner surfaces of the trim to effectively increase removal forces, thereby facilitating connection of the trim to the housing cam The finger-like projections of the clip are initially maintained slightly out of plane and flex independently of each other in order to improve positioning of the trim relative to the ceiling opening and to prevent dislodgment of the clip from engagement with the trim in an installed situation.

The pull-on clip of the invention is formed of spring steel having a thickness of approximately 0.02 inch in order to provide desired resiliency. The clip is further provided with a bend formed essentially medially of its length in order to provide the capability of snugging reflector trim portions up against a ceiling opening during a simple one-motion insertion of the reflector trim assembly into a lamp housing or can. The pull-on clip of the invention deflects on insertion into the interior of the can to hold the reflector trim assembly within the interior of the can by the spring force exerted by the clips attached to the trim.

Accordingly, it is an object of the present invention to provide an improved reflector trim assembly including associated structure which has pull-on clips manually mountable thereto without the use of tools and in a job site environment so that the reflector trim assembly can be inserted into a lamp housing or can in but a single motion with the pull-on clips acting to retain the reflector trim assembly within the can with positive positioning of lamping carried by the assembly and with positive engagement of annular flange-like lower portions of the reflector trim assembly about a ceiling opening above which a downlighting fixture "rough-in" is mounted, the clip having an improved attachment end for facilitating mounting of the clip to the trim and an improved bifurcated distal end which improves the ability of the clip to maintain the trim assembly within the can.

It is another object of the invention to provide a mechanically simple and inexpensive pull-on clip which can be assembled to a reflector trim on a job site without the use of tools, thereby allowing operational economies in manufacture, product shipment and job-site installation, the pull-on clip being improved at the attachment end by the provision of a locking tab of a greater length which acts as a lead-in element which does not damage those portions of the reflector trim over which the locking tab must pass to find engagement with a slot formed in the reflector trim for receiving the locking tab, thereby to lock the tab within the slot and therefore positively mount the clip to the trim, the tab preventing the clip from being pushed back and forth and/or off the trim during installation and handling.

It is a further object of the invention to provide an inexpensive pull-on clip for retaining a reflector trim assembly within the interior of a lamp housing or can of a downlight fixture "roughing", the clip being locked in place on a reflector trim by a simple and rapid linear pull-on motion of the clip relative to the trim to lock the clip in place on said trim, the improvement further comprising a bifurcated distal end having flexible finger-like elements which are preferably initially out of plane and which flex to engage sharpened points thereof with inner wall surfaces of the trim to engage the trim and to snug the trim in place about an opening formed in the ceiling.

Further objects and advantages of the invention will become more readily apparent in light of the following detailed description of the preferred embodiments.

DESCRIPTION OF THE PREFERRED EMBODIMENTS

The invention particularly improves upon the pull-on clip disclosed and claimed in U.S. Pat. No. 5,707,143, the disclosure of which is incorporated hereinto by reference. It is to be understood that the present clip can be used in essentially all situations in which the clip of the patent finds utility and can be mounted to reflector trim in essentially the same manner. Further, the improved clip of the present invention can maintain a reflector trim and associated lamping and socket elements within a downlighting housing or can as is shown and described in the aforesaid patent.

Figure 1:
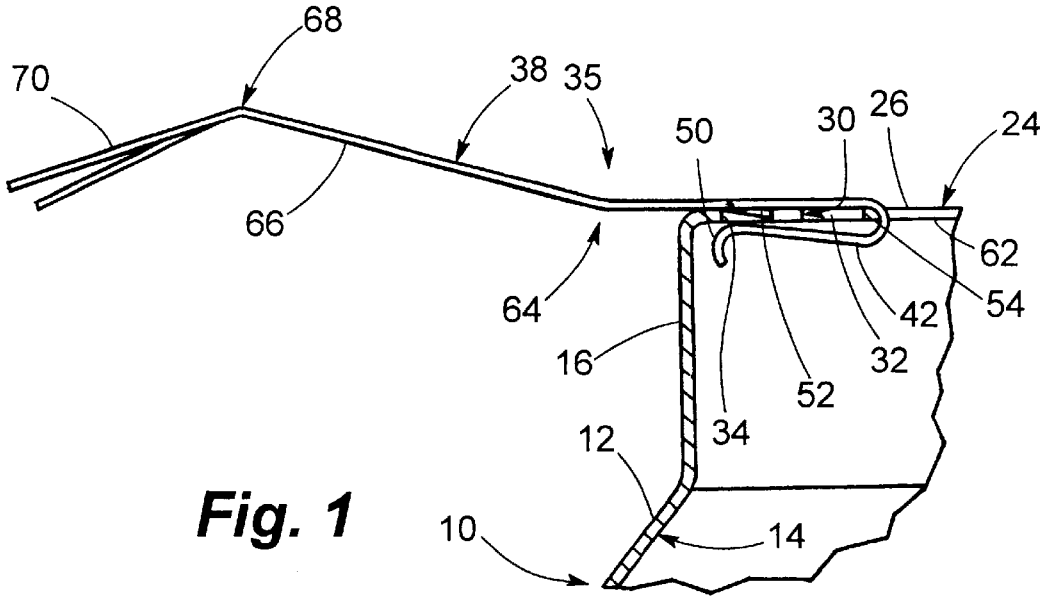
FIG. 1 is a detail sectional view of a portion of a clip and reflector trim with the clip assembled to the reflector trim.
Figure 2:
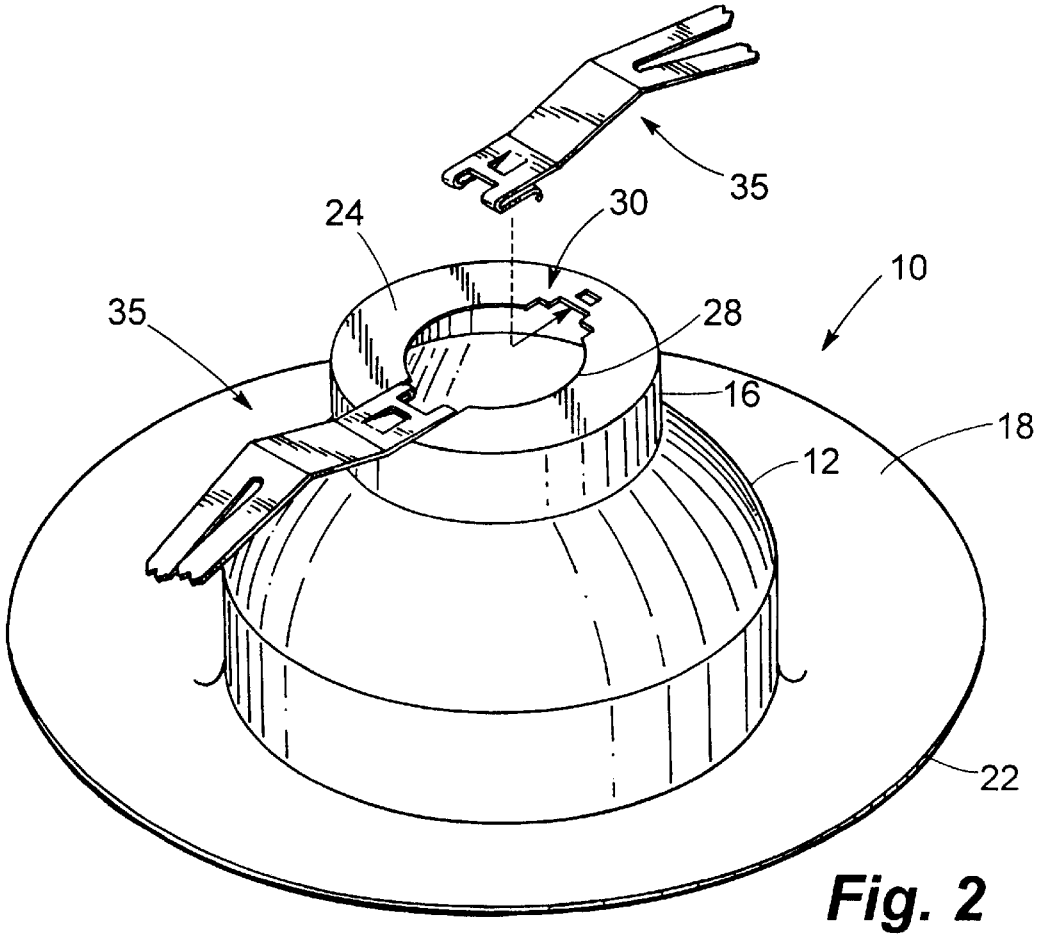
FIG. 2 is a perspective view of the reflector trim and the pull-on clips of the invention, one of the clips being assembled to the reflector trim and the other clip being shown in an assembly relation thereto.

Referring now to the drawings and particularly to FIGS. 1 through 3, a reflector trim is seen at 10, the trim being essentially identical in most respects to conventional reflector trim used in optical assemblies of conventional downhighting fixtures. The reflector trim 10 essentially comprises what is known in the art as a fill optical reflector which optimizes lamp performance. Structure such as the reflector trim 10 can be formed in a variety of shapes and sizes and can be spun or drawn from materials including anodized aluminum or other aluminum alloys, steel, and the like. Trim such as the reflector trim 10 can be painted with high reflectivity coatings such as white polyester powder paint which is durable and easily cleanable. Trim such as the reflector trim 10 can be utilized with inexpensive "A" lamps, R-lamps, par lamps, halogen par lamps or other lamping as appropriate. Trim such as the reflector trim 10 is also available in various colors and finishes as is commonplace in the industry.

The reflector trim 10 is seen to comprise a bulbous body portion 12 having interior surfaces which are highly reflective and which define a reflective cavity which optimizes lamp performance. The trim 10 can have any number of shapes including conventional shapes available in the market. It is to be understood that the body portion 12 can be shaped other than as explicitly shown in the drawings and described herein without departing from the scope of the invention. The body portion 12 is seen to be terminated at the top of the trim 10 by means of a cylindrical cap 16 which is preferably integrally formed with the body portion 12 as is depending flange-like skirt 18 which terminates the body portion 12 about opening 20. The skirt 18 can be formed of a substantially planar annular flange but is preferably formed in a dished-out fashion as is conventional in order that periphery 22 of the skirt 18 can effectively provide one annular edge which provides the sole loci of points which contact ceiling surfaces.

Planar penultimate surface 24 of the trim 10 is formed with an opening 26 centrally disposed within the circular surface 24, the opening 26 having a circular central portion 28 bordered on diametrically opposed sides of the opening 26 by T-shaped notch portions 30. The opening 26 is shown in detail in FIG. 3B. Leg portions 32 of each of the notch portions 30 extend outwardly of the central portion 28, the notch portions 30 communicating with the central portion 28 of the opening 26 at top portions of the T-shaped notch portions 30. The opening 26 thus takes the form of a circular aperture having T-shaped projections formed in diametrically opposed relation to each other. Immediately outwardly of the leg portions 32 of each of the notch portions 30 is formed a rectangular slot 34. The opening 26 and the slots 34 are conveniently and conventionally punched into the surface 24.

As is further seen in FIGS. 1 through 3A, pull-on clips 35 mount to the reflector trim 10 by reception into the T-shaped notch portions 30 and the rectangular slot 34, each one of the clips 35 mounting to a combination of one of the notch portions 30 and one of the rectangular slots 34 which portions 30 and slot 34 are located in adjacent relation to each other. A total of two of the pull-on clips 35 are used in the embodiment of the invention shown in FIGS. 1 through 3A for a given reflector trim 10 having the opening 26 configured as described. It is to be understood that the opening 26 could be otherwise configured, such as by having a greater number of the T-shaped notch portions 30 formed about the periphery of the circular central portion 28 of the opening 26. Such notch portions 30 would preferably be regularly disposed about the central portion 28 of the opening 26 with three or four of the clips 35 being suitable for use. However, the preferred embodiment as shown utilizes two of the clips 35 arranged in diametrically disposed relationship to each other across the circular central portion 28 of the opening 26.

Figures 3A, 3B, 4, 5, 6:
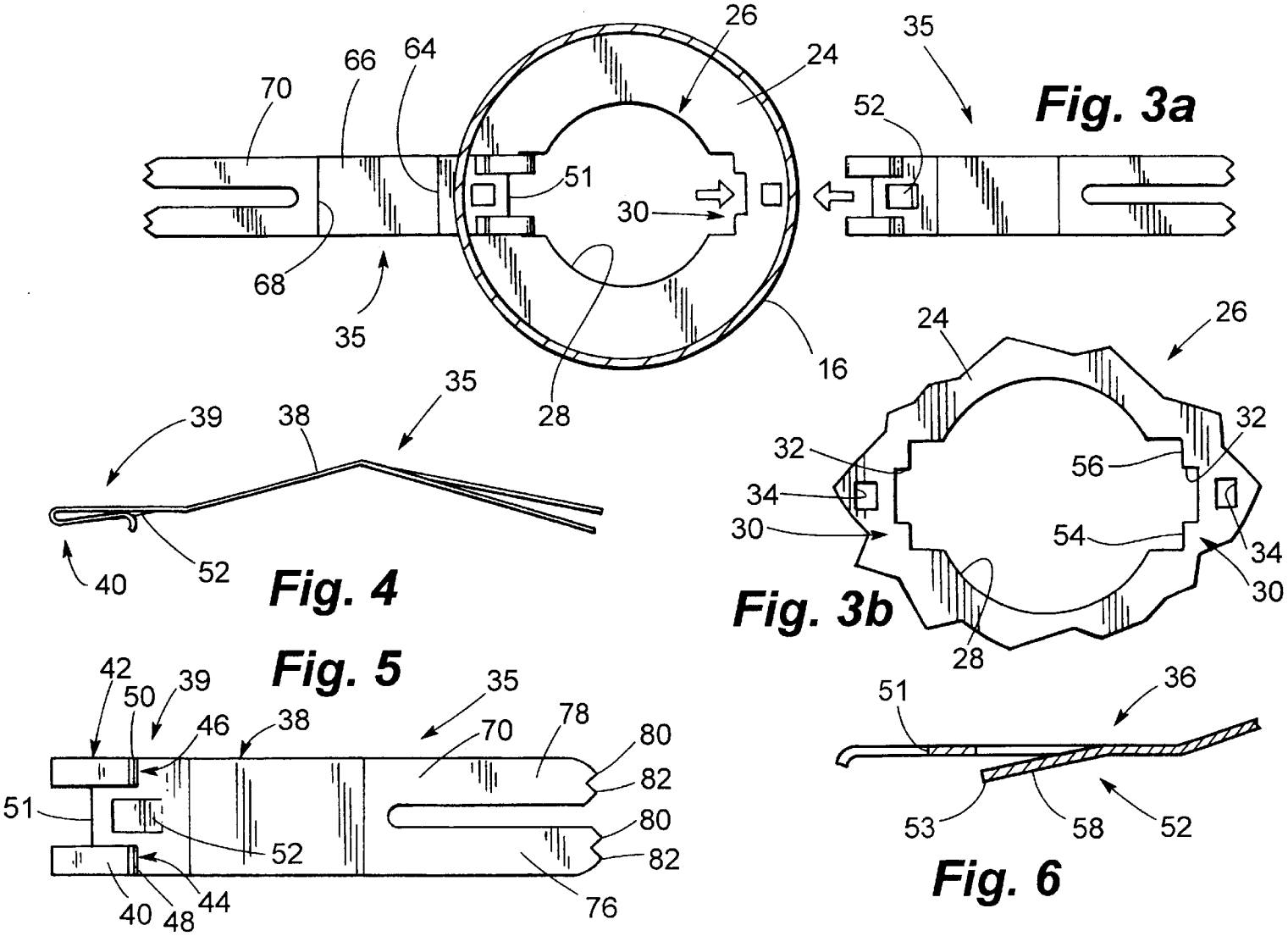
FIG. 3A is a sectional view of an upper portion of the reflector trim taken from a point interiorly thereof and showing one of the pull-on clips assembled thereto and a second clip in an assembly relationship.
FIG. 3B is a detail view of the opening formed in the top of the reflector trim.
FIG. 4 is a side elevational view of the pull-on clip.
FIG. 5 is a plan view of the pull-on clip.
FIG. 6 is a detail view of the locking tab of the clip.

Referring also to FIGS. 4 through 6 in addition to continuing reference to FIGS. 1 through 3B, the structure of the pull-on clip 35 can be appreciated as well as the mounting thereof to the reflector trim 10. The pull-on clip 35 is seen to be formed of a single length of spring steel such as C-1050 steel of a thickness of 0.020 inch as an example. The grain direction of the spring steel is preferably along the longitudinal axis of the clip 35. The material forming the clip 35 preferably has a Rockwell Hardness of between Rc 43–46, the value and the range being increased relative to the clip of U.S. Pat. No. 5,707,143 in order to prevent rocking of the clip 35 once assembled to the trim The clip 35 comprises a body portion 38 formed of a flat length of spring steel stock prior to forming of the clip 35, the body portion 38 being formed at an attachment end 39 to have bent clipping elements 40 and 42 formed along each side of said end 39, the elements 40 and 42 being essentially identical in structure and being formed of recurved lateral portions of the clip 35 and terminating in arcuate distal tips 44 and 46, the clipping elements 40 and 42 being bent to a radius which causes arcuate pressure surfaces 48 and 50 to be respectively formed immediately anteriorly of said tips 44, 46 on respective clipping elements 40, 42. The body portion 38 of the clip 35 terminates essentially medially of the length of the clipping elements 40, 42, said elements 40, 42 extending beyond effective end 51 of the clip 35. A locking tab 52 is formed in the body portion 38 of the clip 35 at a location between the tips 44, 46 and spaced from the end of the body portion 38. The locking tab is preferably punched and formed from the material of the body portion 38 in a downward direction toward the tips 44, 46. The locking tab 52 is substantially rectangular in conformation with a length approximately twice as great as the length of the rectangular slot 34 at each end of the surface 24 of the trim 10 such that the locking tab 52 passes over that portion of the surface 24 lying between the opening 26 and the rectangular slot 34 when the clip 35 is engaged within the opening as shown particularly in FIGS. 1 and 3, the locking tab 52 snap-fitting into the rectangular slot 34 as the clip 35 is pulled into place within the T-shaped notch portion 30 of the opening 26. As the clip 35 is attached to the reflector trim 10 to engage the locking tab 52 within the rectangular slot 34, the clipping elements 40 and 42 respectively receive portions of the surface 24 bordering and defining shoulders 54, 56 respectively. The shoulders 54, 56 contact distal interior surfaces of the clipping elements 44, 46 with the arcuate pressure surfaces 48, 50 resiliently biasing up against interior wall 62 disposed about the opening 26 interiorly of the cylindrical cap 16. The clipping elements 40, 42 thus effectively engage and hold two portions of the reflector trim 10 as shown and described while at the same time the locking tab 52 is received into and engages in locking fashion within the rectangular slot 34. Once the clip 35 is so engaged, the clip 35 can only be removed by an intentional deformation of the body of the clip 35 to disengage the locking tab from the rectangular slot 34.

Referring now particularly to FIG. 6 as well as continuing with reference to the remaining drawings, the locking tab 52 is seen to be provided with a lead-in element 53 which terminates body portion 58 of the locking tab 52. The body portion 58 is seen to extend from the plane of the clip 35 at an angle whereas the lead-in element 53 substantially lies in a plane which is essentially parallel to the plane in which a surmounting portion of the clip 35 lies. The lead-in element 53, due to its essentially upwardly bent relation to the plane of the body portion 58 rides over that portion of the surface 24 lying between the opening 26 and the rectangular slot 34 and does not gouge, deform or otherwise damage that portion of the surface 24 as indicated. It is to be understood that the distal end of the lead-in element 53 could be further upturned to prevent presentation of an end structure which could damage the surface 24. However, the slightly bent nature of the lead-in element 53 relative to the body portion 58 of the locking tab 52 suffices to allow for ease of assembly of the clip 35 to the trim 10 without damage to any portion of the surface 24. The length of the locking tab 52 relative to corresponding structure in U.S. Pat. No. 5,707, 143 is substantially twice that of the corresponding structure in the patent. The additional length of the locking tab 52 of the present invention is desirable in order to provide a lead-in which mounts the clip 35 to the trim 10 without damage to the trim 10.

The clip 35 differs from the clip of U.S. Pat. No. 5,707,143 in another respect relative to the inside radius at which the clipping elements 40 and 42 are bent, the preferred inside radius being 0.025 inch. The newly chosen radius reduces unnecessary movement of the clip in a vertical direction.

As is best seen in the drawings, and particularly FIGS. 1, 2 and 5, the body portion 38 of the clip 35 bends substantially upwardly at 64 at a preferred angle of approximately 15° to form spring section 66 which then bends downwardly at 68 to form distal section 70, the angle of the distal section per se to horizontal preferably being approximately 16° although fingers 76, 78 forming major portions of the distal section 70 preferably lie in different planes. The length of the spring section 66 is greater than the extended lengths of the clipping elements 40, 42 and anterior flat section 72 of the clip 35. The spring section 66 preferably has a length approximately 25 per cent greater than the length of the portion of the clip 35 disposed anteriorly of the bend at 64. The distal section 70 of the clip 35 preferably has a length approximately 30 to 35 per cent greater than the length of the distal section 66, these relative lengths being otherwise dimensioned as desired but being preferred in order to accomplish intended results. The distal section 70 is notched at 74 to define the fingers 76, 78 and thus to bifurcate the distal section 70. Points 80 and 82 are respectively formed on the distal ends of the fingers 76, 78, the points 80, 82 providing effective contact with structure within which the reflector trim is received. Those portions of the clip 35 formed by bending of the body portion 38 at 64 and at 68 to form the spring section 66 and the distal section 70 respectively function to facilitate a "snugging up" of the skirt 18 of the reflector trim against ceiling surfaces.

The clips 35 engage interior surfaces 14 of the trim 10 by virtue of the points 80, 82 of the fingers 76, 78 digging into the material forming said surfaces 14 and essentially connecting the clip 35 thereto. A single point could be formed on one each of the fingers 76, 78. The flexing nature of the fingers 76, 78 as well as other portions of the clips 35 bias the trim 10 and any structure connecting thereto upwardly within a housing or can to position the reflector trim 10 such that a gap cannot occur between the skirt 18 of the trim 10 and an opening formed in a ceiling above which the present structure is mounted as part of a downlighting fixture. Essentially, the clip 35 functions in a manner similar to the operation of the clip 36 described in U.S. Pat. No. 5,707,143, as to the free end of the clip 35. However, the fingers 76, 78 provide improved operation of the clip 35 with the multiple points 80, 82 on the respective fingers 76, 78 providing improved engagement with the interior of the housing can and resistance to removal of the trim from the can. The reflector trim 10 provided with the clips 35 not only accomplishes this reflecting function but also its trimming function by virtue of the operation of the clips 35.

The structure thus described is seen to provide the advantages referred to hereinabove and in U.S. Pat. No. 5,707,143. In particular, the clips 35 themselves can be inexpensively manufactured and are not intended to be assembled to a reflector trim such as the trim 10 in a manufacturing environment. Accordingly, a number of the reflector trims 10 can be nested together during shipment to a job site. It is to be understood that various lamp housings and pan assemblies can be utilized without departing from the scope of the invention The embodiments of the pull-on clip of the invention shown and described herein function to provide substantial advantages in the art especially in combination with a reflector trim assembly comprising a reflector trim such as the reflector trim 10 and pull-on clips such as the clips 35. Further, the invention provides substantial advantages to the operation and use of an assembly such as the aim assembly comprises with a socket assembly (not shown in the drawings) which also utilizes pull-on clips such as the clips 35. It is therefore to be noted that the invention can be embodied other than as explicitly illustrated and described herein without departing from the scope of the invention, the inventive scope being defined by the recitations of the appended claims.

What is claimed is:

1. A clip for mounting a reflector trim within a lamp housing of a lighting fixture mounted above a ceiling opening formed in a ceiling, the reflector trim having a reflector trim opening formed in one end thereof to receive a portion of the lamp socket, the reflector trim opening communicating with notches formed about the periphery of the opening in the trim, the trim further having a slot formed in juxtaposition to each one of the notches, the clip comprising:

an anterior end portion having a locking tab formed therein, the locking tab having a lead-in element formed distally thereof and lying out of plane with remaining portions of the locking tab, the locking tab engaging and having at least a portion thereof received into one of the slots when the anterior end portion of the clip is pulled over one of the notches; and, at least one clipping element formed in the anterior end portion of the clip and being recurved distally to receive and bias against edge portions of the trim defining the notches to facilitate mounting of the clip to the trim.

2. The clip of claim 1 wherein body portions of the clip are formed of a single piece of spring steel stock.

3. The clip of claim 1 and further comprising:

a medial portion of the clip formed at an angle to the anterior end portion of the clip; and, a distal portion of the clip formed at an angle to the medial portion of the clip, the medial and distal portions of the clip acting on engagement with interior walls of the lamp housing to pull the reflector trim and lamp socket mounted thereto inwardly of the lamp housing to fit the trim snuggly against the ceiling about the ceiling opening.

4. The clip of claim 3 wherein the distal portion of the clip is bifurcated to form flexible finger elements.

5. The clip of claim 4 wherein end portions of the finger elements of the clip are formed into spaced points for engagement with interior walls of the lamp housing.

6. The clip of claim 4 wherein the finger elements lie out of plane with each other prior to and on assembly to the trim.

7. The clip of claim 4 wherein body portions of the clip are formed of a single piece of spring steel stock.

8. The clip of claim 1 wherein distal end portions of the finger elements are formed into spaced points for engagement with interior walls of the lamp housing.

9. The clip of claim 1 wherein a body portion of the locking tab is formed out of plane with the anterior end portion of the clip and extends from a side of the clip along which the at least one clipping element recurves.

10. The clip of claim 1 and further comprising:

a distal portion of the clip formed at an angle to the anterior end portion of the clip.

11. The clip of claim 10 wherein end portions of the distal portion of the clip are formed into spaced points for engagement with interior walls of the lamp housing.

12. The clip of claim 10 wherein body portions of the clip are formed of a single piece of spring steel stock.

13. A clip for mounting a reflector trim within a lamp housing of a lighting fixture, the reflector trim having an opening formed in one end thereof to receive a portion of a lamp socket, the reflector trim having at least one slot formed therein and spaced from the opening, the clip comprising:

a body element having first and second end portions;

locking means formed in a first end of the body element for engaging the at least one slot when the first end is pulled over a perimetric portion of the opening from which the at least one slot is spaced;

clipping means formed in the first end portion of the body element for receiving and biasing against edge portions of the perimetric portion of the opening from which the at least one slot is spaced to facilitate mounting of the clip to the trim; and, a distal portion of the clip bifurcated to form flexible finger elements of a length which constitutes a major portion of the length of the distal portion of the clip.

14. The clip of claim 13 wherein the body element is formed of a single piece of spring steel stock.

15. The clip of claim 13 wherein the locking means comprise a locking tab formed in the body element, the locking tab engaging and being received into the at least one slot.

16. The clip of claim 13 wherein the clipping means comprise at least one clipping element which is recurved distally to receive and bias against edge portions of the perimetric portion of the opening from which the at least one slot is spaced to facilitate mounting of the clip to the trim.

17. The clip of claim 15 wherein the locking means comprise a locking tab formed in the body element, the locking tab engaging and being received into the at least one slot, the locking tab having a lead-in element formed distally thereof, the lead-in element lying out of plane with body portions of the locking tab.

18. The clip of claim 17 wherein a body portion of the locking tab is formed out of plane with the first end portion of the clip and extends from a side of the clip along which the at least one clipping element recurves.

19. The clip of claim 13 wherein a distal portion of the body element comprising the second end portion thereof is formed at an angle to the first end portion of the body element.

20. The clip of claim 19 wherein end portions of the distal portion of the finger elements are formed into spaced points for engagement with interior walls of the lamp housing.

21. The clip of claim 13 wherein the reflector trim has a plurality of slots formed therein and spaced from the opening, one each of the clips engaging one each of the slots.

22. The clip of claim 4 wherein the flexible finger elements are of a length which constitutes a major portion of the length of the distal end portion of the clip.

23. The clip of claim 22 wherein the finger elements lie out of plane with each other prior to and on assembly to the trim.

24. The clip of claim 16 wherein the radius of the distally recurved portion of the at least one clipping element is 0.025 inch.

* * * * *